US005516053A

United States Patent [19]

Hannu

[11] Patent Number: 5,516,053

[45] Date of Patent: May 14, 1996

[54] WELDED METAL HARDFACING PATTERN FOR CONE CRUSHER SURFACES

[76] Inventor: Donald W. Hannu, 3101 - 37th St. NW, Mandan, N. Dak. 58554

[21] Appl. No.: 192,966

[22] Filed: Feb. 7, 1994

Related U.S. Application Data

[63] Continuation-in-part of Ser. No. 133,450, Oct. 7, 1993, abandoned.

[51] Int. Cl.[6] ..... B02C 2/04

[52] U.S. Cl. ..... 241/207; 241/293

[58] Field of Search ..... 241/207, 293, 241/208, 209

[56] References Cited

U.S. PATENT DOCUMENTS

| | | | |
|---|---|---|---|
| 3,075,067 | 1/1963 | Axhelm . | |
| 3,526,939 | 9/1970 | Nikkanen . | |
| 3,565,354 | 2/1971 | Gittings . | |
| 3,583,649 | 6/1971 | Adam et al. . | |
| 4,168,036 | 9/1979 | Werginz . | |
| 4,513,919 | 4/1985 | Terrenzio . | |
| 4,610,320 | 9/1986 | Beakley . | |
| 4,682,987 | 7/1987 | Brady et al. . | |
| 4,694,918 | 9/1987 | Hall . | |
| 4,787,564 | 11/1988 | Tucker | 241/275 |
| 4,976,470 | 12/1990 | Arakawa . | |
| 5,050,810 | 9/1991 | Parham . | |
| 5,115,991 | 5/1992 | Seari . | |
| 5,165,613 | 11/1992 | Keller . | |
| 5,203,513 | 4/1993 | Keller et al. . | |
| 5,269,477 | 12/1993 | Buchholtz et al. | 241/293 |

FOREIGN PATENT DOCUMENTS

| | | |
|---|---|---|
| 4116374 | 11/1992 | Germany . |

*Primary Examiner*—John Husar

*Attorney, Agent, or Firm*—Dorr, Carson, Sloan & Birney

[57] ABSTRACT

An improved cone crusher for crushing rock and the like has a welded metal hardfacing pattern made by welding beads of chromium carbide or similar hardfacing material to selected portions of its crushing surfaces. Tungsten carbide particles are introduced into the weld puddle as the beads are deposited. Predetermined spacing is maintained between adjacent beads to expose portions of the crushing surfaces. The beads can be deposited in recessed grooves in the crushing surfaces for increased lateral support. In the preferred embodiment, the beads are welded in a concentric circular pattern on the mantle and bowl liner of the cone crusher.

18 Claims, 3 Drawing Sheets

Fig. 7
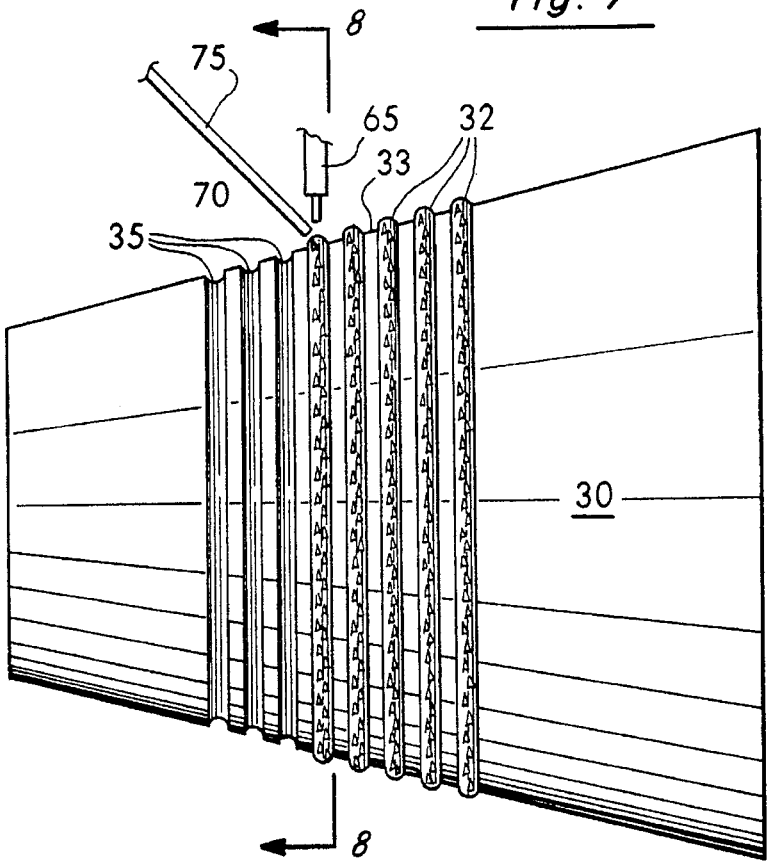
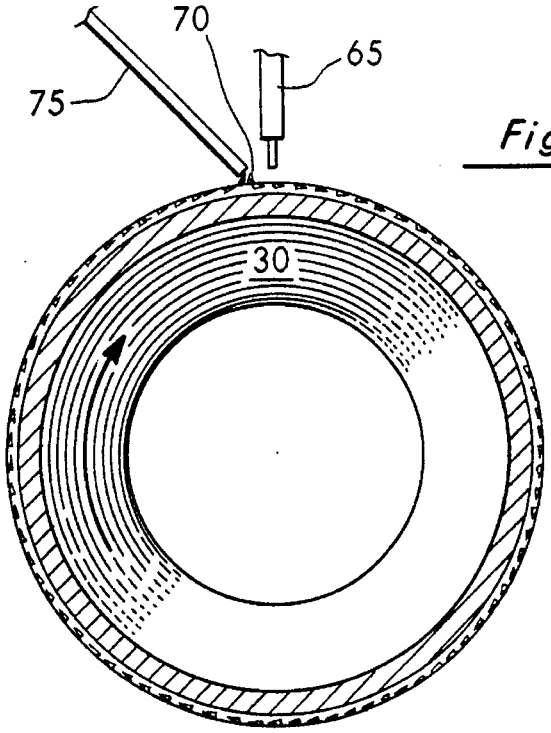
Fig. 8

WELDED METAL HARDFACING PATTERN FOR CONE CRUSHER SURFACES

RELATED APPLICATION

The present application is a continuation in part of the Applicant's U.S. patent application Ser. No. 08/133,450, entitled "Welded Metal Hardfacing Pattern for Cone Crusher Surface," filed on Oct. 7, 1993 now abandoned.

BACKGROUND OF THE INVENTION

1. Field of the Invention

The present invention relates generally to the field of cone crushers used for crushing rock, and other material. More specifically, the present invention discloses a hardfacing pattern for cone crusher surfaces in which a series of welded beads containing tungsten carbide particles are welded to the crusher surfaces with spacing between the beads.

2. Statement of the Problem

Cone crushers are typically used for crushing rock, ore, construction materials, and the like and have a cross-section similar to that shown in FIG. 1. The cone crusher 10 includes a mantle (or breaking cone) 30 mounted on a shaft 50, and a bowl liner 20 within which the mantle 30 is disposed. As shown in greater detail in FIG. 2, the mantle 30 has a generally convex annular or tapered conical shape that extends radially outward from an axis that is off-vertical. The upper surface of the mantle 30 functions as a crushing surface during operation of the cone crusher, as depicted in FIG. 1. The bowl liner 20 is normally mounted about a vertical axis and features a substantially concave annular crusher surface as shown in FIG. 3.

A motor drives the shaft 50 and mantle 30 to gyrate relative to the bowl liner 20. Rocks 40 or other material to be crushed are introduced into the hopper formed by the upper portion of the bowl liner 20. The rocks 40 fall into the space separating the mantle 30 from the bowl liner 20. The gyrating motion of the mantle 30 causes these rocks to be crushed between the mantle 30 and the bowl liner 20.

The crushing surfaces of both the mantle 30 and bowl liner 20 are made of a tough metallic material such as manganese steel. These crushing surfaces are frequently covered with a thin, continuous layer of a harder material (known as hardfacing) to enhance the wear characteristics of the assembly. For example, a continuous layer containing chromium carbide is sometimes applied to the crushing surfaces. The hardfacing can be applied by welding overlapping beads to form a substantially continuous layer over the manganese steel crushing surfaces.

A number of cone crushers have been invented in the past, including the following:

| Inventor | Pat. No. | Issue Date |
|---|---|---|
| Axhelm | 3,075,067 | Jan. 22, 1963 |
| Adam et al. | 3,583,649 | June 8, 1971 |
| Werginz | 4,168,036 | Sep. 18, 1979 |
| Arakawa | 4,976,470 | Dec. 11, 1990 |
| Saari | 5,115,991 | May 26, 1992 |
| Schwechten | German OLS 4116374 | Nov. 19, 1992 |

Axhelm discloses an automatic welding apparatus for making a continuous weld on the surface of a crusher roller. This results in a smooth hard surface on the worn roller (col. 1, lines 31–34).

Adam et al. disclose a wear part for use in a crusher. The crushing member is prestressed in compression sufficiently to overcome the tension stresses normally produced by the crushing operation. This prestressing may be accomplished by an annular band secured around the outer circumference of the crushing member.

Werginz discloses a cone crusher having an improved frame structure, an anti-spin mechanism, and an improved crusher setting indicator. FIG. 1 of the Werginz patent indicates that the crushing surfaces of the mantle 191 and the bowl liner 17 have a number of annular lips or edges.

Arakawa discloses a cone crusher having a gyrating mantle and a bowl liner above the mantle. The space between the mantle and bowl liner is automatically adjusted by hydraulic pressure that moves the bowl liner upward to accommodate load fluctuations and abnormal overloads.

Saari discloses another example of a gyratory cone crusher. The space separating the crushing surfaces can be adjusted by actuation of hydraulic cylinders pivotally connected to both the main frame and the bowl assembly.

Schwechten discloses a method for producing a wear-resistant surface by applying a coating of a hard material. Fields of hard material are obtained by filling the depressions formed by ridges of a buffer material connected with the base material of the machine part. The ridges of buffer material are formed by casting, machining, or welding. The hard material can be applied by casting or welding. The drawings suggest that the entire surface of the machine part is to be covered by the ridges and hard material. The invention is intended for use in roll mills, rock crushers, briquette and pellet presses, forging equipment, and other similar equipment.

Tungsten carbide has long been known to have a hardness close to that of diamond. Consequently, tungsten carbide has been used extensively for cutting or grinding in situations requiring extreme resistance to wear and abrasion. The following are a few examples:

| Inventor | Pat. No. | Issue Date |
|---|---|---|
| Brady et al. | 4,682,987 | July 28, 1987 |
| Hall | 4,694,918 | Sep. 22, 1987 |
| Beakley | 4,610,320 | Sep. 9, 1986 |
| Terrenzio | 4,513,919 | Apr. 30, 1985 |

Brady et al. disclose a method and composition for producing hard surface carbide insert tools. A slurry coating containing hard nickel, metal alloy powder, and a fluxing agent is fused to bond an abrasive insert, such as tungsten carbide in a base metal matrix, to a cutting tool.

Hall discloses a percussion rock bit with a plurality of diamond tip inserts. The inserts have a cemented tungsten carbide body partially embedded in the steel bit and at least two layers at the protruding drilling portion of the insert. The outermost layer contains polycrystalline diamond. The remaining layers are transition layers containing a composite of diamond crystals and precemented tungsten carbide.

Beakley discloses a method for applying large tungsten carbide particles to the surface of stabilizer blades used in the drilling of oil, gas, geothermal and water wells. A soft, elastic metal powder is first applied to the substrate surface, as shown in FIG. 2 of the Beakley patent. Large tungsten carbide particles 20 that have also been coated with the soft powder are placed on top of the layer of soft powder, as shown in FIG. 3 of the patent. The tungsten carbide particles 20 are covered with additional soft powder, which is then fused to form a homogeneous mixture bonded to the substrate. A hard matrix 30 is applied and fused over the mixture 14 below, as shown in FIG. 5.

Terrenzio discloses a feed arrangement for a centrifugal rock crusher having a circular housing and an impeller that rotates concentrically. The impeller throws rock against an impact surface within the housing to crush the rock. Terrenzio further discusses that the wear life of the end surfaces 146 of the lip body 142 can be extended by imbedding an insert made of a hard material, such as tungsten carbide, within the end of the lip body 142 (column 9, lines 47–63).

3. Solution to the Problem. None of the prior art references uncovered in the search show a cone crusher having a metal hardfacing pattern made by welding staggered beads containing tungsten carbide particles to the crushing surfaces with spacing between adjacent beads to expose portions of the crushing surfaces. This is counter-intuitive in that incomplete covering of the crushing surfaces would generally be expected to reduce wear life. Instead, use of the invention in the field has consistently demonstrated that wear life is doubled or tripled over that of conventional cone crushers.

It is believed that the staggered beads in the present invention serve to reduce high stress patterns that otherwise occur within crushing surfaces having a continuous layer of hardfacing. These high stress levels can cause propagation of cracks that destroy the crushing surfaces. The welded beads in the present invention do not form a continuous layer, and therefore help to resist crack propagation through the crushing surfaces.

Another factor that may contribute to increased wear life in the present invention relates to the work hardening characteristics of the manganese steel commonly used to form the crushing surfaces. Manganese steel gradually hardens as it is subject to repeated deformation. However, in a conventional cone crusher, the manganese steel on the exposed top layer of the crushing surfaces may be worn away by the rock before significant work hardening can occur. Similarly, in a conventional cone crusher with a continuous layer of hardfacing above the manganese steel, the hardfacing is harder than manganese steel and tends to protect the underlying manganese steel from deformation and work hardening until the hardfacing has been worn away. In contrast, the spacing between adjacent welded beads in the present invention subjects the manganese steel substrate to significantly greater deformation during the crushing operation. This gives the manganese steel extensive time to work harden before the hardfacing pattern wears away. The welded beads in the present invention also serve to better grip the rock to produce a more uniform end product.

SUMMARY OF THE INVENTION

This invention provides an improved cone crusher for crushing rock and the like having a welded metal hardfacing pattern made by welding beads of chromium carbide or similar hardfacing material to selected portions of its crushing surfaces. Tungsten carbide particles are introduced into the weld puddle as the beads are deposited. The beads are staggered to maintain spacing between adjacent beads and thereby expose portions of the crushing surfaces. The beads can be deposited in recessed grooves in the crushing surfaces for increased lateral support. In the preferred embodiment, the beads are welded in a concentric circular pattern on the mantle and bowl liner of the cone crusher.

A primary object of the present invention is to provide a means for greatly extending the wear life of the crushing surfaces in a cone crusher.

Another object of the present invention is to provide a means for allowing the crushing surfaces to better grip the rocks and thereby produce a more uniform end product.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 7 is a side view of the mantle in a second embodiment of the present invention in which the welded beads are deposited into recessed grooves in the mantle and tungsten carbide particles are introduced into the weld puddle as the beads are deposited.

FIG. 8 is a cross-sectional view of the mantle corresponding to FIG. 7.

DETAILED DESCRIPTION OF THE INVENTION

Figure 1:
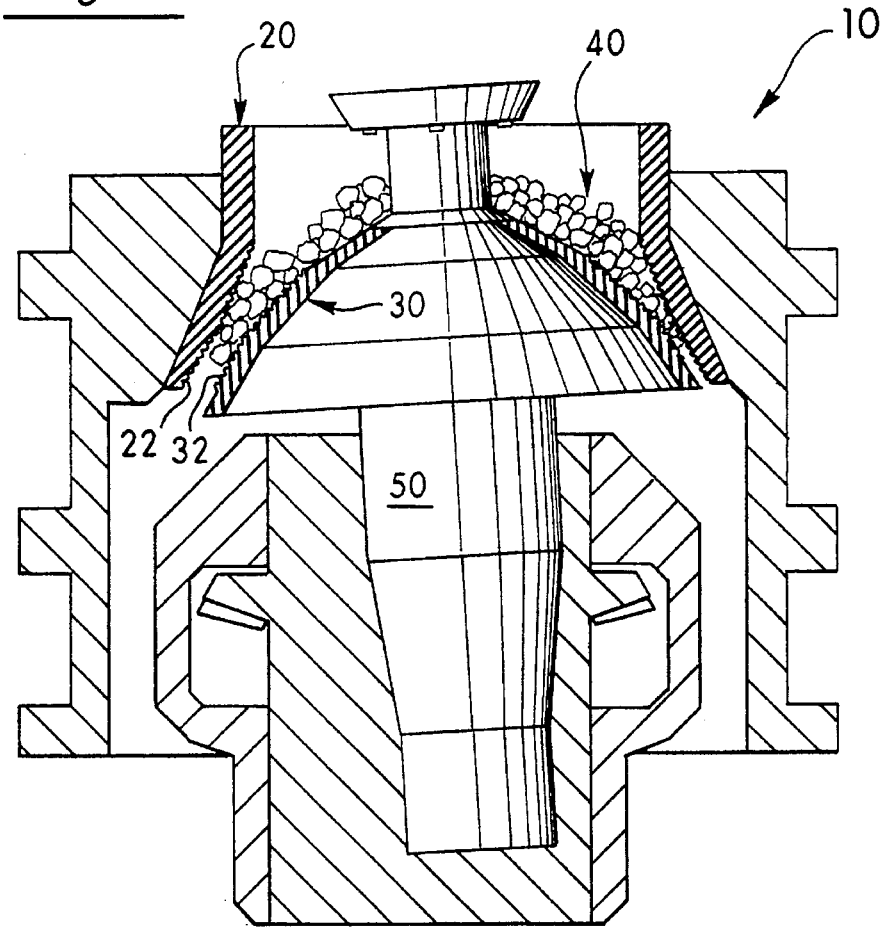
FIG. 1 is a side cross-sectional view of a cone crusher with crushing surfaces that incorporate the present invention.
Figure 2:
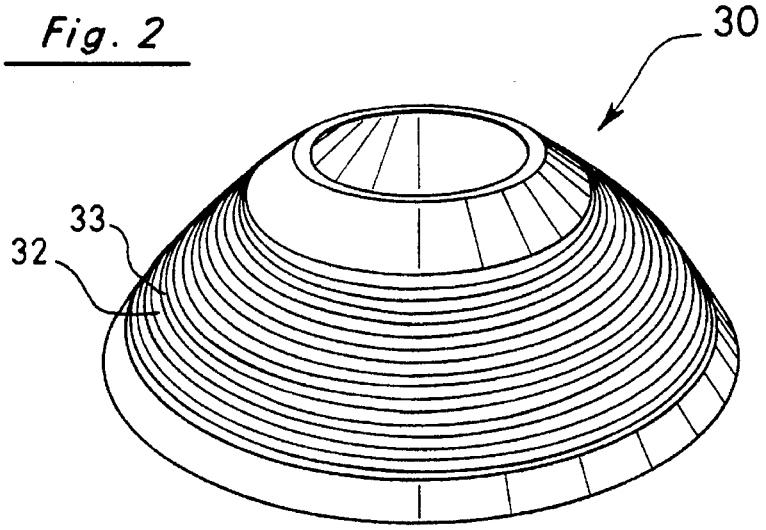
FIG. 2 is a perspective view of the mantle of the cone crusher shown in FIG. 1.

FIG. 1 provides a cross-sectional view of a cone crusher 10 embodying the present invention. As previously discussed, the cone crusher includes a bowl liner 20 and mantle 30. The mantle 30 is mounted on and supported by a shaft 50 that gyrates about an axis at a predetermined angle with respect to the vertical axis of the bowl liner. The crushing surfaces of the mantle 30 and bowl liner 20 are made of conventional manganese steel as previously discussed.

The crushing surfaces of the mantle 30 and bowl liner 20 are first sandblasted to ensure clean surfaces for welding. A pattern of welded beads 22 and 32 is then applied to the crushing surfaces. The beads are applied by open arc welding in the preferred embodiment, although other welding techniques could be used instead. A space 33 is intentionally left between adjacent beads 32 on the mantle 30, so that portions of the underlying manganese steel crushing surface remain exposed. This is shown most clearly in FIGS. 4–6. Similarly, a space 23 is also left between adjacent beads 22 on the bowl liner 20 to exposed portions of the underlying manganese steel crushing surface.

Figure 3:
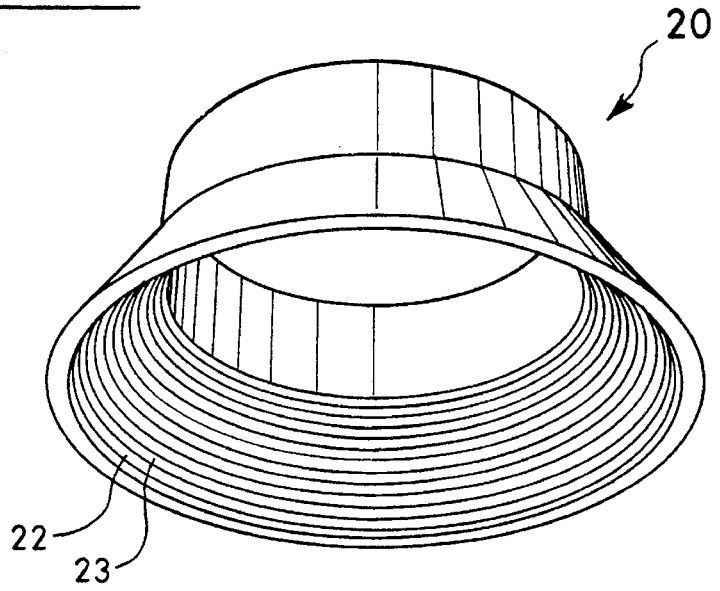
FIG. 3 is a perspective view of the bowl liner of the cone crusher shown in FIG. 1.

Virtually any pattern of welded beads can be applied to the mantle 30 and bowl liner 20. In the preferred embodiment, a concentric circular pattern of beads is welded to each crushing surface. As shown in FIGS. 1 and 3, the crushing surface of bowl liner 20 has a generally concave annular shape extending radially outward from the vertical axis.

Given this configuration, the welded beads 22 are applied as a series of concentric rings centered about the vertical axis. Similarly, the mantle 30 has a generally convex annular crushing surface extending radially outward from an axis of symmetry that is off-vertical. Here again, the welded beads 32 am applied as a series of concentric rings centered about this axis of symmetry. Concentric circular patterns of this type tend to better grip the rock as it descends from the hopper into the space between the crushing surfaces of the mantle 30 and the bowl liner 20. This gripping action retards rocks from falling too quickly through the crusher, and thereby helps ensure thorough crushing of the rock and a more uniform end product.

The beads can be manually applied by an experienced welder, or by means of a welding machine that automatically applies each circular bead and then indexes radially inward (or outward) by a predetermined increment to apply the next circular bead in the pattern. Alternatively, the welded beads can have the form of spirals, lines, or other shapes.

The beads should be harder than the underlying substrate (e.g., manganese steel) of the crushing surfaces. In the preferred embodiment, the beads are created with a Stoody 100HC welding rod (Stoody Company, Bowling Green, Ky.) having a composition of approximately 4.3% carbon, 1.5% manganese, 1.5% silicon, 25% chromium, 1% molybdenum, and the balance iron. This welding rod forms a bead containing a substantial proportion of chromium carbide. It should be expressly understood that other welding rod formulations could be substituted. In addition, any of a wide variety of equivalent hardfacing materials known in the industry could be employed that are harder than manganese steel.

The previous discussion has assumed that welded beads are applied to both the mantle 30 and bowl liner 20. It should be understood that the cone crusher will function satisfactorily even if the beads are applied to only one of the crushing surfaces, although wear life might not be as long. It is also possible to apply the welded beads only to selected portions of each crushing surface.

Figure 4:
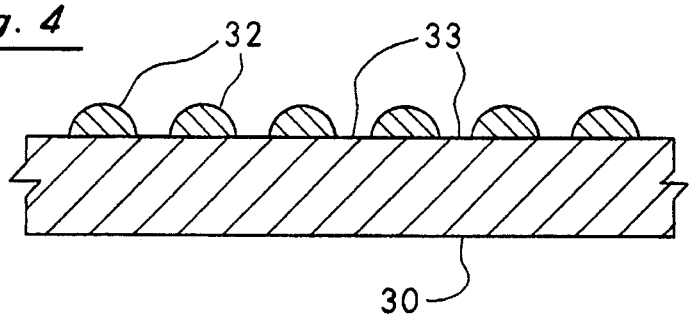
FIG. 4 is a cross-sectional view of a portion of the surface of the mantle with small welded beads.
Figure 5:
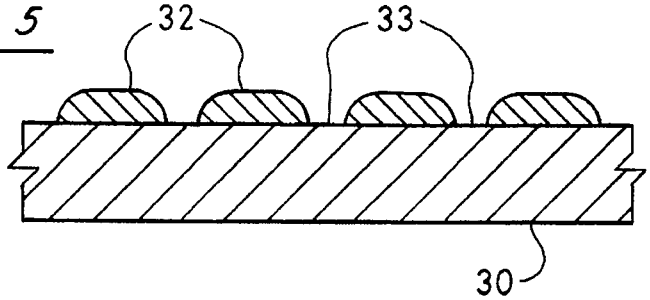
FIG. 5 is a cross-sectional view of a portion of the surface of the mantle with heavier welded beads for coarse crushing.
Figure 6:
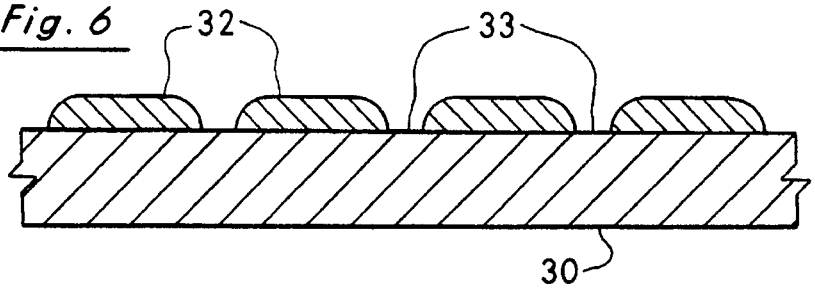
FIG. 6 is a cross-sectional view of a portion of the surface of the mantle with wider welded beads for crushing finer materials

FIGS. 4 through 6 show examples of three different sizes of welded beads 32 that can be applied to the crushing surfaces. The smallest bead size shown in FIG. 4 has a width of approximately ⅜ inches, a height of approximately 3/16 inches, and a spacing 33 between adjacent beads of approximately 3/16 inches. These dimensions have been found suitable for all-purpose rock crushing, but especially for material ranging from ⅜ to ¾ inch material.

The heavier beads 32 shown in FIG. 5 are intended primarily for coarser crushing (i.e., material sizes of ⅞ inches and larger). Here, the beads have a width of approximately ⅝ inches, a height of approximately 3/16 inches, and a spacing 33 between adjacent beads of approximately 3/16 inches.

Finally, the wider beads 32 shown in FIG. 6 are used primarily for fine crushing for material sizes of ¼ inch and less. The beads 32 have a width of approximately ⅞ inches, a height of approximately 3/16 inches, and a spacing 33 between adjacent beads of approximately 3/16 inches.

The bead can be formed in a single pass, or alternatively by a plurality of overlapping beads deposited in several passes. Multiple passes are especially helpful in creating wider beads as shown in FIG. 6. It is also possible to create a bead having bands of dissimilar materials by means of multiple passes. For example, two side ridges for each bead can be made by using a Stoody 100HC welding rod. The region between the two side ridges is then filled in by using a Stoody 145 welding rod to create a single bead. Spacing is maintained between adjacent beads, as previously discussed.

A welded metal hardfacing pattern can also be applied to the crushing surfaces of a rock crusher using the alternative embodiment of the present invention, as shown in the side view of a mantle 30 illustrated in FIG. 7. A corresponding cross-sectional view is provided in FIG. 8. A number of grooves 35 are first ground or cut into the crushing surface of the mantle 30. The grooves 35 are then filled with a welded metallic bead as shown in the right-hand portion of FIG. 7. For example, a conventional arc welding process can be used to deposit a welded bead containing chromium carbide or other hardfacing materials into the grooves 35. Particles of tungsten carbide 70 are introduced into the weld puddle through a tubular feeder 75 as the bead is deposited in each groove 35 by the electrode feed system 65.

Tungsten carbide has a hardness approaching that of diamond, but it is very brittle. The grooves 35 in the crushing surfaces contain the tungsten carbide particles 70 and chromium carbide within the matrix of the welded bead to provide lateral support. This enhances the ability of the tungsten carbide particles in the welded bead to withstand the impact of crushing and yet gives outstanding wear performance.

FIGS. 7 and 8 also show one means for depositing the welded beads and introducing tungsten carbide into the weld puddle. A number of grooves 35 are first ground into the crushing surface of the mantle 30 by conventional means. The grooves 35 typically form either a concentric circular pattern or a spiral pattern about the axis of the mantle 30, although other patterns could be used. In the preferred embodiment, the grooves have a width of approximately ⅜ to ¾ inches and a depth of approximately ¼ to ½ inches. The spacing 33 between adjacent grooves is approximately 3/16 inches, as previously discussed. A fixture is then used to rotate the mantle 30 about its axis, while the electrode feed system 65 and the feeder tube 75 for the tungsten carbide particles 70 remain essentially stationary. The electrode feed system 65 gradually advances the welding rod, which contains a high percentage of chromium and carbon, as before, to form a bead containing a substantial proportion of chromium carbide. The electrical arc between the welding rod and the crushing surface causes the bead to be deposited into the groove 35 as it passes beneath the tip of the welding rod. Tungsten carbide particles are introduced through the feeder tube 75 into the weld puddle while it remains molten. The final welded bead 32 overfills the groove 35 to create a generally circular or oval cross-sectional shape extending above the surface of the mantle, as shown in FIG. 7. The width of each welded bead is roughly equal to the width of the groove 35 (i.e., approximately ⅜ to ¾ inches). The depth or thickness of each bead is approximately ⅜ to ¾ inches, which is usually fixed as a function of the width and depth of the groove.

The welded bead can be deposited in a single rotation of the fixture, or by an accumulation of layers over multiple rotations if desired. Accumulation over multiple rotations may be advantageous in helping to distribute the tungsten carbide particles more evenly throughout the bead.

If the grooves 35 form concentric circles, the electrode feed system 65 and the tungsten carbide feeder tube 75 remain stationary as each groove is filled over one or more rotations of the fixture, and then index laterally to the next groove to repeat the procedure. If the groove 35 forms a spiral, the electrode feed system 65 and the tungsten feeder tube 75 slowly move laterally to track the spiral shape of the groove as the mantle rotates.

FIG. 7 and 8 show the welded bead being deposited on the crushing surface of the mantle 30. It should be expressly understood that the present invention can also be readily applied to the crushing surface on the bowl liner 20 of a cone crusher. It could also be readily adapted to virtually any other type of rock crusher.

The above disclosure sets forth a number of embodiments of the present invention. Other arrangements or embodiments, not precisely set forth, could be practiced under the teachings of the present invention and as set forth in the following claims.

I claim:

1. In a rock crusher having opposing metallic crushing surfaces, the improvement comprising a hardfacing pattern of metallic beads welded to recessed grooves in said crushing surfaces with spacing maintained between adjacent beads to expose portions of said crushing surfaces, wherein tungsten carbide particles are inserted into said welded beads as they are deposited on said crushing surfaces.

2. The rock crusher of claim 1, wherein said welded beads further comprise chromium carbide.

3. The rock crusher of claim 3, wherein said grooves have a depth of approximately ¼ to ½ inches.

4. The rock crusher of claim 4, wherein said welded beads have a thickness of approximately ⅜ to ¾ inches.

5. The rock crusher of claim 1, wherein said welded beads have a width of approximately ⅜ to ¾ inches.

6. The rock crusher of claim 1, wherein said spacing between adjacent beads is approximately 3/16 inches.

7. In a cone crusher for crushing rock having a mantle with a generally convex, annular crushing surface and a bowl liner with a generally concave, annular crushing surface, the improvement comprising a pattern of recessed grooves on selected portions of said crushing surface of said mantle and bowl liner filled with welded metallic beads with spacing maintained between adjacent beads to expose portions of said crushing surfaces, wherein tungsten carbide particles are inserted into said welded beads as they are deposited in said recessed grooves.

8. The cone crusher of claim 7, wherein said welded beads further comprise chromium carbide.

9. The cone crusher of claim 7, wherein said welded beads have a width of approximately ⅜ to ¾ inches.

10. The cone crusher of claim 7, wherein said grooves have a depth of approximately ¼ to ½ inches.

11. The cone crusher of claim 10, wherein said welded beads have a thickness of approximately ⅜ to ¾ inches.

12. The cone crusher of claim 7, wherein said spacing between adjacent beads is approximately 3/16 inches.

13. In a cone crusher for crushing rock and the like, having a mantle with a generally convex, annular crushing surface extending radially outward about a first axis and a bowl liner with a generally concave, annular crushing surface extending radially outward about a second axis, the improvement comprising:

a concentric circular hardfacing pattern of metallic beads welded to recessed grooves in said mantle crushing surface about said first axis with spacing maintained between adjacent beads to expose portions of said mantle crushing surface, wherein tungsten carbide particles are inserted into said beads as said beads are deposited on said mantle crushing surface; and a concentric circular hardfacing pattern of metallic beads welded to recessed grooves in said bowl liner crushing surface about said second axis with spacing maintained between adjacent beads to expose portions of said bowl liner crushing surface, wherein tungsten carbide particles are inserted into said beads as said beads are deposited on said bowl liner crushing surface.

14. The cone crusher of claim 13, wherein said welded beads further comprise chromium carbide.

15. The cone crusher of claim 13, wherein said welded beads have a width of approximately ⅜ to ¾ inches.

16. The cone crusher of claim 13, wherein said grooves have a depth of approximately ¼ to ½ inches.

17. The cone crusher of claim 16, wherein said welded beads have a thickness of approximately ⅜ to ¾ inches.

18. The cone crusher of claim 13, wherein said spacing between adjacent beads is approximately 3/16 inches.

* * * * *